US009839949B2

(12) United States Patent
Frobose et al.

(10) Patent No.: US 9,839,949 B2
(45) **Date of Patent: *Dec. 12, 2017**

(54) METHOD FOR PRODUCING A STEEL TUBE INCLUDING CLEANING OF THE INNER TUBE WALL

(71) Applicant: SANDVIK MATERIALS TECHNOLOGY DEUTSCHLAND GMBH, Dusseldorf (DE)

(72) Inventors: Thomas Frobose, Versmold (DE); Udo Rauffmann, Werther (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/778,193

(22) PCT Filed: Mar. 11, 2014

(86) PCT No.: PCT/EP2014/054730

§ 371 (c)(1),
(2) Date: Sep. 18, 2015

(87) PCT Pub. No.: WO2014/146936

PCT Pub. Date: Sep. 25, 2014

(65) Prior Publication Data

US 2016/0193640 A1 Jul. 7, 2016

(30) Foreign Application Priority Data

Mar. 18, 2013 (DE) ..... 10 2013 102 704

(51) Int. Cl.
*B21B 45/02* (2006.01)
*B65H 19/30* (2006.01)
(Continued)

(52) U.S. Cl.
CPC ..... *B21B 45/0284* (2013.01); *B21B 21/00* (2013.01); *B21B 37/74* (2013.01);
(Continued)

(58) Field of Classification Search
CPC ..... B21B 45/0269; B21B 45/0275; B21B 45/0278; B21B 45/0281; B21B 45/0284;
(Continued)

(56) References Cited

U.S. PATENT DOCUMENTS 4,611,789 A 9/1986 Ackert et al.
4,739,640 A 4/1988 Hurst et al.
(Continued)

FOREIGN PATENT DOCUMENTS

CN 202700985 U 1/2013
DE 102008003494 A1 7/2009
(Continued)

OTHER PUBLICATIONS

Keeney C A et al: "Cryogenic Blast Cleaning", Aise Steel Technology, Aise, Pittsburgh, PA, US. vol. 75 No. 1, Jan. 1, 1998, p. 56/57, XP00732788.
(Continued)

*Primary Examiner* — Teresa M Ekiert
(74) *Attorney, Agent, or Firm* — Morgan, Lewis & Bockius LLP

(57) ABSTRACT

A method for producing a steel tube including the step of the manufacturing a steel tube having an inner tube wall, an outer tube wall, and a free tube cross-section enclosed by the inner tube wall, wherein after the manufacturing, the steel tube includes at least one contaminant on the inner tube wall. After the manufacturing of the steel tube, the inner tube wall is cleaned by introducing liquid or solid $CO_2$ into the free
(Continued)

tube cross-section, and of applying the liquid or solid $CO_2$ onto the inner tube wall to remove the contaminant therefrom.

14 Claims, 2 Drawing Sheets

(51) Int. Cl.
*B21B 21/00* (2006.01)
*B21B 37/74* (2006.01)

(52) U.S. Cl.
CPC ... *B65H 19/305* (2013.01); *B65H 2301/4148* (2013.01); *B65H 2301/41812* (2013.01); *B65H 2301/41826* (2013.01); *B65H 2301/41829* (2013.01); *B65H 2553/412* (2013.01)

(58) Field of Classification Search
CPC ..... B21B 45/0287; B21B 21/00; B21B 37/74; B21B 38/006; B21B 45/0272; B65H 19/305
See application file for complete search history.

(56) References Cited

U.S. PATENT DOCUMENTS

| | | | |
|---|---|---|---|
| 5,580,845 | A | 12/1996 | Ruane |
| 5,592,863 | A | 1/1997 | Jaskowiak et al. |
| 5,626,050 | A | 5/1997 | Ploughe et al. |
| 5,778,744 | A | 7/1998 | Braun et al. |
| 6,382,886 | B1 | 5/2002 | Jaeger |
| 7,513,121 | B2 | 4/2009 | Zurecki et al. |
| 2011/0232352 | A1 | 9/2011 | Hayashi |
| 2013/0209186 | A1 | 8/2013 | Quintard et al. |
| 2015/0314374 | A1 | 11/2015 | Frobose |
| 2015/0321258 | A1 | 11/2015 | Frobose |
| 2016/0279688 | A1 | 9/2016 | Frobose et al. |

FOREIGN PATENT DOCUMENTS

| | | | |
|---|---|---|---|
| EP | 0 094 740 | A1 | 11/1983 |
| EP | 0098492 | A2 | 1/1984 |
| EP | 0 612 834 | A1 | 8/1994 |
| EP | 0645208 | A1 | 3/1995 |
| EP | 1044762 | A2 | 10/2000 |
| EP | 1208940 | A2 | 5/2002 |
| EP | 1580284 | A2 | 9/2005 |
| GB | 2106819 | A | 4/1983 |
| GB | 2199519 | A | 7/1988 |
| JP | S5992115 | A | 5/1984 |
| WO | 2004033154 | A1 | 4/2004 |
| WO | 2012/052650 | A1 | 4/2012 |

OTHER PUBLICATIONS

Communication pursuant to Article 94(3) EPC dated Apr. 13, 2017 issued in corresponding European Patent Application No. 14709637.4.
Notification of the Second Office Action dated Jun. 2, 2017, for corresponding Chinese Patent Application No. 201480017004.9.
Notification of the Second Office Action dated May 31, 2017, for Chinese Patent Application No. 201480017005.3.

METHOD FOR PRODUCING A STEEL TUBE INCLUDING CLEANING OF THE INNER TUBE WALL

RELATED APPLICATION DATA

This application is a §371 National Stage Application of PCT International Application No. PCT/EP2014/054730 filed Mar. 11, 2014 claiming priority of DE Application No. 102013102704.0, filed Mar. 18, 2013 and related to co-pending U.S. patent application Ser. No. 14/778,123 filed Sep. 18, 2015.

The present invention relates to a method for producing a steel tube comprising the manufacturing of a steel tube with an inner tube wall, an outer tube wall, and a free tube cross section enclosed by the inner tube wall, wherein after the manufacturing, the steel tube comprises at least one contaminant on the inner tube wall, and entailing, after the manufacturing of the steel tube, cleaning of the inner tube wall.

For producing high precision metal tubes, particularly metal tubes made of steel, an expanded hollow cylindrical blank in the completely cooled state is subjected to cold reduction by compressive stress. In the process, the blank is formed into a tube having a defined reduced outer diameter and a defined wall thickness.

The most commonly used method for reducing tubes is known as cold pilgering, wherein the blank is referred to as a hollow shell. The hollow shell is pushed during the rolling over a calibrated rolling mandrel, i.e., a rolling mandrel having the inner diameter of the finished tube, and in the process it is gripped from the outside by two calibrated rolls, i.e., rolls that define the outer diameter of the finished tube, and rolled in the longitudinal direction over the rolling mandrel.

During cold pilgering, the hollow shell is fed step-wise in the direction of the rolling mandrel and over and past the latter, while the rolls are moved back and forth horizontally as they rotate, over the mandrel and thus over the hollow shell. In the process, the horizontal movement of the rolls is predetermined by a roll stand, on which the rolls are rotatably mounted. In known cold pilger rolling mills, the roll stand is moved back and forth by means of a crank drive in a direction parallel to the rolling mandrel, while the rolls themselves are set in rotation by a rack which is stationary relative to the roll stand, and with which toothed wheels that are firmly connected to the roll axles engage.

The feeding of the hollow shell over the mandrel occurs by means of a feeding clamping carriage, which is set in translational motion in a direction parallel to the axle of the rolling mandrel.

The conically calibrated rolls arranged one above the other in the roll stand rotate opposite to the feeding direction of the feeding clamping carriage. The so-called pilger mouth, which is formed by the rolls, grips the hollow shell, and the rolls push off a small wave of material outward, which is stretched out by the smoothing pass of the rolls and by the rolling mandrel to the intended wall thickness, until the idle pass of the rolls releases the finished tube. During the rolling, the roll stand with the rolls attached to it moves opposite to the feeding direction of the hollow shell. By means of the feeding clamping carriage, the hollow shell is advanced by an additional step onto the rolling mandrel, after the idle pass of the rolls has been reached, while the rolls with the roll stand return to their horizontal starting position. At the same time, the hollow shell undergoes a rotation about its axis, in order to achieve a uniform shape of the finished tube. As a result of repeated rolling of each tube cross section, a uniform wall thickness and roundness of the tube as well as uniform inner and outer diameters are achieved.

In order to reduce the friction between the rolling mandrel and the hollow shell during the forming, a lubricant, also referred to as a mandrel bar lubricant, is applied to the rolling mandrel. After the forming, this lubricant adheres at least partially to the inner tube wall of the finished tube. While such a contaminant of the inner tube wall consisting of residual mandrel bar lubricant is unimportant for some applications of the finished tubes, for other applications the inner tube wall has to be cleaned at great cost. Here, the cleaning of the inner tube wall is made difficult in particular because the finished tubes can have a relatively small diameter and a long length.

However, similar contaminants of the inner tube wall also appear in alternative forming techniques, such as the cold drawing of tubes, for example.

In tube drawing, an already tubular blank is formed in a cold state on a drawing bench so that it receives the desired dimensions. However, not only does the drawing allow a precise dimensioning of the finished tube, which is adjustable at will, but the cold forming also achieves a hardening of the material, i.e., its elastic limit and strength are increased, while at the same time its elongation values become smaller. This optimization of the material properties is a desired effect of tube drawing for many application purposes, for example, in high-pressure technology and medical technology, in aircraft construction, but also in general machine construction.

Depending on the material used, a distinction is made between the so-called hollow drawing, the core drawing, and the bar drawing. Whereas in the case of hollow drawing only the outer diameter of the tube is reduced in a tool referred to as a drawing ring or drawing die, in the case of core drawing and bar drawing, the inner diameter and the wall thickness of the drawn tube are also defined.

An undesired effect during the cold drawing of tubes is the so-called rattling. Here, due to high friction between the tool and the tube to be drawn, an irregular drawing speed occurs. In the most disadvantageous case, the tube moves intermittently or not at all relative to the tool or at a high speed. As a result of the rattling, grooves form, particularly on the inner surface of the drawn tube.

To achieve uniform drawing speeds and to prevent rattling, drawing oils are therefore used in order to reduce the sliding friction between the tube to be drawn and the tools.

From the prior art, various methods are known for cleaning the inner tube wall of a steel tube. Thus, for example, the entire tube can be dipped into a solvent, which then dissolves the contaminant on the inner tube wall and rinses it out of the tube. In an alternative design of the prior art, a cleaning plug is led through the tube, wherein the plug is dimensioned so that it wipes off and absorbs contaminants on the inner tube wall. Such a plug, on its outer surface, is made of felt, for example.

In comparison to this prior art, the aim of the present invention is to provide a method for producing a steel tube, which makes it possible to produce tubes having long lengths, in a manner so that the inner wall is free of contaminants.

The above-mentioned aim is achieved by a method for producing a steel tube comprising the manufacturing of a steel tube with an inner tube wall, an outer tube wall, and a free tube cross section enclosed by the inner tube wall, wherein after the manufacturing, the steel tube comprises at least one contaminant on the inner tube wall and, after the manufacturing, cleaning the inner tube wall with the steps of introducing liquid or solid $CO_2$ into the free tube cross section and applying the liquid or solid $CO_2$ onto the inner tube wall in order to remove the contaminant from the inner tube wall.

Surprisingly, it was found that introducing liquid or solid $CO_2$ into the free tube cross section and applying the liquid or solid $CO_2$ onto the inner tube wall is quite suitable for removing the contaminant from the inner tube wall and thus for cleaning the inner tube wall of the tube.

Here, applying the $CO_2$, in the sense of the present invention, refers to bringing the $CO_2$ in contact or engagement with the inner wall or the contaminant.

While it is possible in principle to clean the inner tube wall alternatively with liquid or solid $CO_2$, liquid $CO_2$ tends to have the disadvantage that, at the time of contact between the liquid $CO_2$ and the wall to be cleaned, a gas film forms between the wall and the liquid $CO_2$, which reduces the cleaning action.

In comparison, solid $CO_2$ not only exhibits an advantageous heat transfer from the solid $CO_2$ to the tube wall to be cleaned or the contaminant, and thus an improved cleaning action, but the solid $CO_2$ also has an abrasive effect, so that, when solid $CO_2$ is used, the method is a blasting cleaning method.

When using solid $CO_2$ for cleaning the inner tube wall, one distinguishes between, on the one hand, a so-called $CO_2$ snow blasting, and, on the other hand, a so-called dry ice blasting. The difference between the two methods is that, in the case of $CO_2$ snow blasting, the solid $CO_2$ is generated in the process itself. In this process, a carrier gas or a driving jet is passed under pressure through a jet line to a jet nozzle, and liquid $CO_2$ is supplied via a feed line, converted by pressure reduction into dry snow, and fed into the jet line, wherein the $CO_2$ from the feed line is introduced through a pressure reduction space having a widened cross section into the jet line. Such a method is known from WO 2004/033154 A1, for example. On the other hand, in the case of dry ice blasting, already solid $CO_2$ is supplied to the process and accelerated therein onto the surface to be cleaned, in this case the inner tube wall.

For the method according to the invention it is not important what time delay exists between the manufacturing of the tube, i.e., the forming process, and the cleaning of the tube. In particular, the method according to the invention can be used in production line manufacturing, wherein the manufacturing and the cleaning occur temporally immediately one after the other. Alternatively, it is also possible for considerably longer time periods, on the order of magnitude of days, weeks or months, to be inserted between the manufacturing and the cleaning.

In an embodiment of the invention, the manufacturing of the steel tube entails the forming, preferably cold forming of a hollow shell to the form of the finished dimensioned steel tube.

Such a forming step, in an embodiment of the invention, is carried out, for example, by cold pilgering the hollow shell to the form of the finished dimensioned steel tube.

In the case of cold pilgering, a mandrel bar lubricant in particular is transferred from a mandrel bar onto the inner tube wall and removed by the method according to the invention, after the manufacturing of the steel tube, by means of the liquid or solid $CO_2$.

In an alternative embodiment, the forming of the hollow shell to the form of the finished tube occurs by cold drawing the hollow shell.

If the forming occurs by cold drawing of the hollow shell to the form of the finished steel tube, then, in an embodiment, a drawing oil is transferred from a drawing core to the inner tube wall and then removed again from the inner tube wall by applying the liquid or solid $CO_2$.

The introduction of the liquid or solid $CO_2$ into the steel tube occurs in an embodiment by means of a cleaning lance, which is introduced into the free tube cross section, so that the $CO_2$ within the steel tube exits the cleaning lance and enters the free tube cross section. During the cleaning, the outlet opening or nozzle of the cleaning lance is then moved in the longitudinal direction through the tube, in order to clean the latter over its entire length.

In an alternative embodiment, the liquid or solid $CO_2$ is introduced from a first end of the steel tube into the free tube cross section. This variant has the advantage that the first end of the tube only has to be connected to the outlet nozzle or opening for the $CO_2$, but no additional steps are necessary subsequently, i.e., during the introduction of the $CO_2$. In particular, it is possible to dispense with a cleaning lance that can be introduced in an automated manner into the tube.

In an embodiment of the method, during the application of the liquid or solid $CO_2$ onto the inner tube wall, the temperature of the steel tube is measured, and the cleaning is interrupted if the temperature of the steel tube falls below a predetermined temperature threshold.

It has been shown that the temperature of a tube cleaned with liquid or solid $CO_2$ is a measure of the cleaning of the tube that has already occurred, i.e., of the cleanliness of the tube. Thus, if the temperature of the tube to be cleaned falls below a certain temperature threshold, then it can be assumed that the tube has reached a desired degree of cleanliness, and that the cleaning with the liquid or solid $CO_2$ can be interrupted.

It is assumed that, when cleaning the inner tube wall, first a heat transfer occurs from the contaminant to the liquid or solid $CO_2$, so that, as long as the tube is still contaminated, the tube itself stays at substantially constant temperature, or on the other hand it undergoes only a slight cooling. It is only when the contaminant has been largely removed from the inner tube wall that a heat transfer from the tube itself to the liquid or solid $CO_2$ occurs, so that the tube undergoes further cooling.

In an embodiment of the invention, in which the solid or liquid $CO_2$ is introduced from the first end of the steel tube into the free tube cross section of the tube, it is advantageous for the temperature of the steel tube to be measured during the cleaning at a second end of the tube, opposite the first end.

Due to the temperature distribution in the tube, one observes that, at the time of the introduction of the $CO_2$ into the tube, the latter first cools at its first end, and that this cooling then spreads until the second end is also cooled. If the temperature of the tube falls below a certain threshold at the second end, then it can be assumed that the tube has been cleaned over its entire length and that the cleaning process can be terminated.

In an embodiment of the invention, the steel tube is a round tube, preferably made of stainless steel.

Additional advantages, features and application possibilities of the present invention become apparent on the basis of the following description of an embodiment and the associated figures.

In the represented embodiments, identical or similar elements are marked with identical reference numerals.

Figure 1:
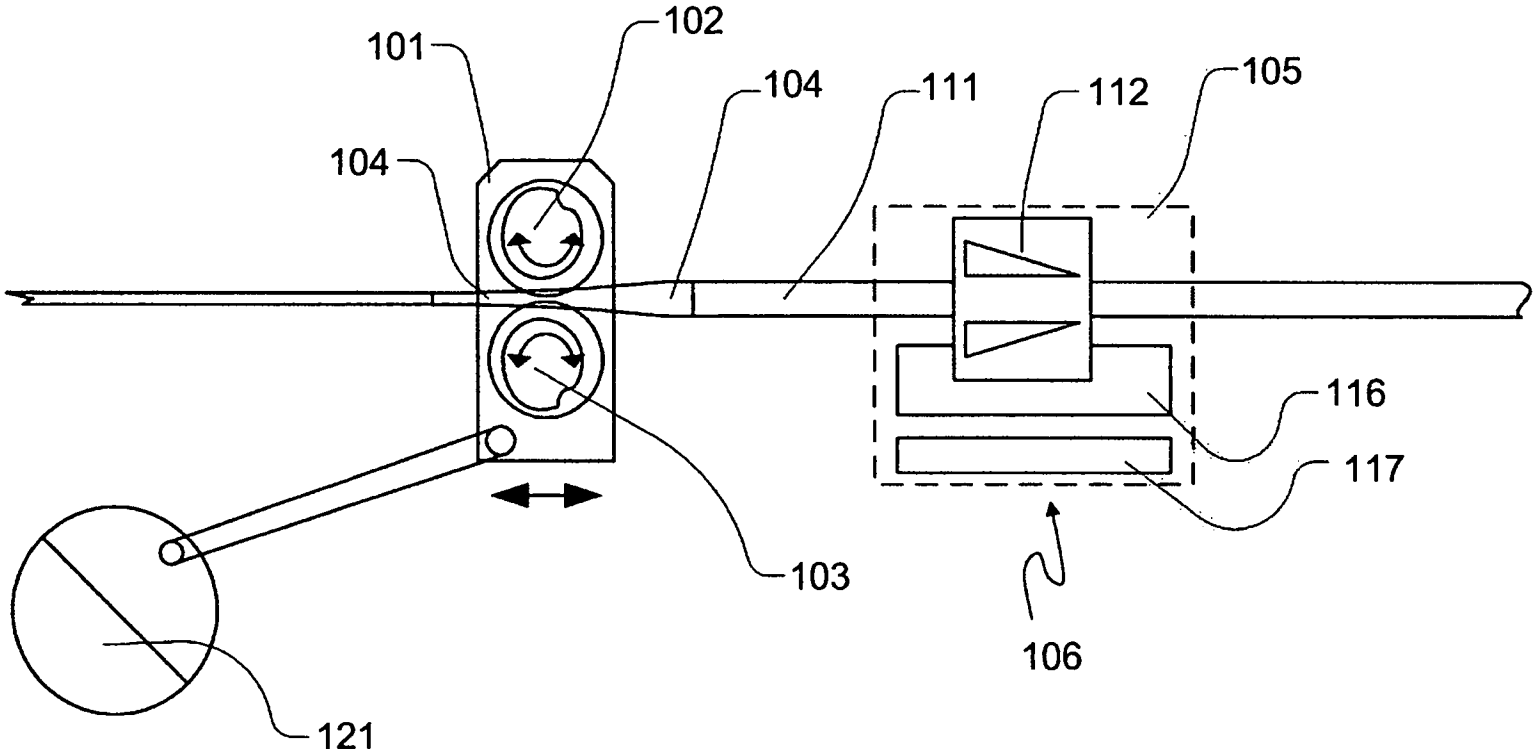
FIG. 1 shows the cold pilger rolling mill from the prior art in a schematically side view.

In FIG. 1, the structure of a cold pilger rolling mill is represented schematically in a side view. The rolling mill consists of a roll stand 101 with rolls 102, 103, a calibrated rolling mandrel 104 as well as a feeding clamping carriage 105. In the represented embodiment, the cold pilger rolling mill has a linear motor 106 as direct drive for the feeding clamping carriage 105. The linear motor 106 is constructed from a rotor 116 and a stator 117.

During the cold pilgering in the rolling mill shown in FIG. 1, the hollow shell 111 is fed step-wise in the direction of the rolling mandrel 104 and over and past the latter, while the rolls 102, 103 as they rotate are moved horizontally back and forth over the mandrel 104 and thus over the hollow shell 111. In the process, the horizontal movement of the rolls 102, 103 is predetermined by a roll stand 101 on which the rolls 102, 103 are rotatably mounted. The roll stand 101 is moved back and forth by means of a crank drive 121 in a direction parallel to the rolling mandrel 104, while the rolls 102, 103 themselves are set in rotation by a rack which is stationary relative to the roll stand 101, and with which toothed wheels that are firmly connected to the roll axles engage.

The feeding of the hollow shell 111 over the mandrel 104 is performed by means of the feeding clamping carriage 105, which allows a translational movement in a direction parallel to the axis of the rolling mandrel. The conically calibrated rolls 102, 103 arranged one above the other in the roll stand 101 rotate in opposite direction to the feeding direction of the feeding clamping carriage 105. The so-called pilger mouth formed by the rolls grips the hollow shell 111 and the rolls 102, 103 push off a small wave of material from outside, which is stretched by a smoothing pass of the rolls 102, 103 and by the rolling mandrel 104 to the predetermined wall thickness, until an idle pass of the rolls 102, 103 releases the finished tube. During the rolling, the roll stand 101 with the rolls 102, 103 attached to it moves against the feeding direction of the hollow shell 111. By means of the feeding clamping carriage 105, the hollow shell 111 is fed by an additional step onto the rolling mandrel 104, after the idle pass of the rolls 102, 103 has been reached, while the rolls 102, 103 with the roll stand 101 return to their horizontal starting position. At the same time, the hollow shell 111 undergoes a rotation about its axis, in order to obtain a uniform shape of the finished tube. As a result of multiple rollings of each tube section, a uniform wall thickness and roundness of the tube as well as uniform inner and outer diameters are achieved.

In order to reduce the friction between rolling mandrel 104 and the mandrel bar supporting the rolling mandrel 104, respectively, and the hollow shell 111, a mandrel bar lubricant, for example, a graphite-containing lubricant, is applied onto the rolling mandrel 104. This mandrel bar lubricant forms residues on the inner tube surface of the finished reduced tube. The aim is to remove this residue from the inner tube wall over the entire length of the tube by means of the process steps according to the invention which are described below.

In the embodiment of the invention described here as an example, the cold pilger rolling mill is used in order to manufacture the steel tube, i.e., in order to form the hollow shell to the form of the finished tube. However, this forming step of the method according to the invention could also occur alternatively by cold drawing the hollow shell, for example.

Figure 2:
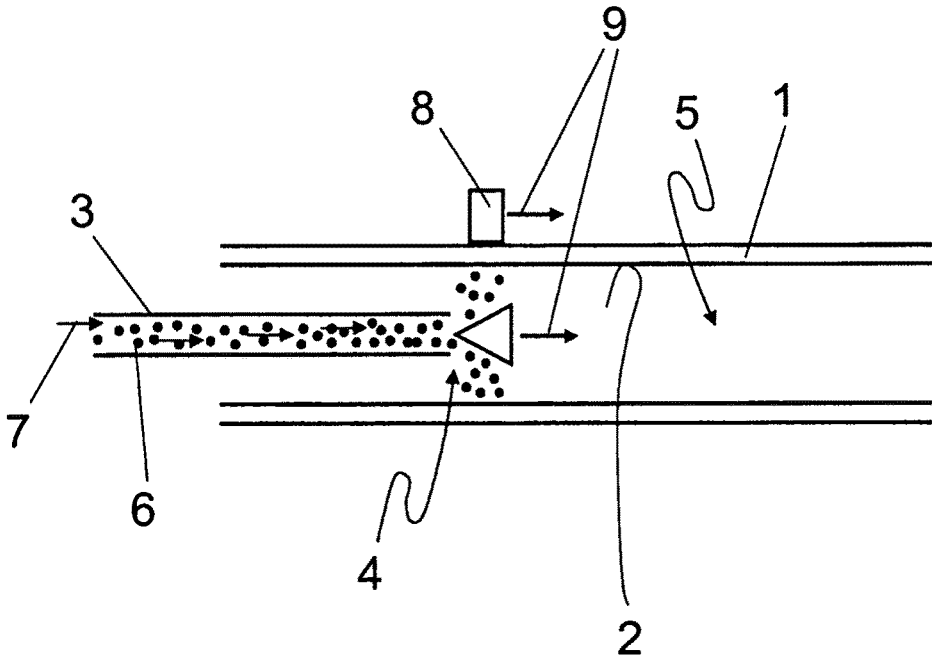
FIG. 2 shows a schematically cross-sectional view of an embodiment for carrying out the cleaning steps according to the invention.

FIG. 2 shows a dry snow blasting of the inner tube wall of a finished reduced tube 1 obtained by cold pilgering, for example. In this dry snow blasting, the tube 1 contaminated on its inner tube wall during the cold pilgering is cleaned to remove the mandrel bar lubricant. For this purpose, a cleaning lance 3 is introduced into the tube 1, so that its outlet nozzle 4 is located in the free tube cross section 5 of the tube 1.

Through the cleaning lance 3, dry snow 6 is fed by means of pressurized air 7 into the tube, and it is blasted through the outlet nozzle 4 onto the inner tube wall 2 so that the latter is cleaned by means of the dry snow. Here, the dry snow is used, on the one hand, as a cleaning agent, i.e., for dissolving the contaminant, and, on the other hand, also as an abrasive which, in a manner similar to sandblasting, detaches the contaminant from the inner tube wall. The contaminant detached from the inner tube wall 2 is removed from the tube 1 by means of the pressurized air jet.

In the embodiment of FIG. 2, the temperature of the tube 1 is measured by means of a temperature sensor 8. Here, the temperature sensor 8 is moved simultaneously with the cleaning lance 3 along the tube 1, wherein the temperature sensor 8 is always located approximately at the level of the outlet nozzle 4 of the cleaning lance 3.

If one assumes that, at the time when the dry snow 6 strikes a contaminant on the inner tube wall 2, the contaminant first undergoes cooling, and is subsequently removed from the inner tube wall 2, then an appreciable cooling of the tube 1 itself occurs only when the contaminant is removed from the inner tube wall 2. If therefore the temperature of the tube 1 measured by the temperature sensor 8 falls below a predetermined temperature threshold, then it is assumed that the inner tube wall has been completely cleaned at the site where the temperature sensor 8 is currently located. In order to clean the tube 1 over its entire length, the cleaning nozzle 4 at the tip of the cleaning lance 3 and the temperature sensor 8 are moved slowly in the longitudinal direction along the tube, as indicated by the arrows 9.

Figure 3:
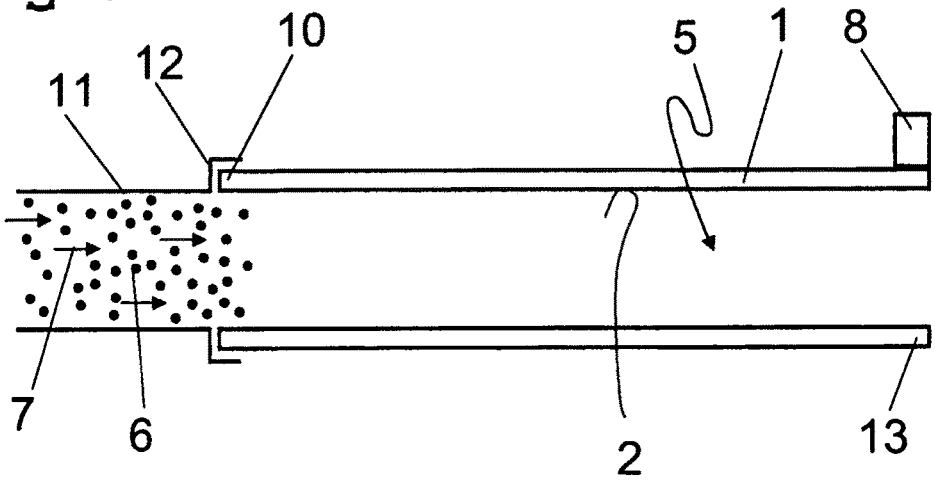
FIG. 3 shows a schematically cross-sectional view of an alternative embodiment for carrying out the cleaning steps.

FIG. 3 shows an alternative arrangement for blasting the inner tube wall 2 of a steel tube 1 using dry snow 6. In this alternative embodiment, the dry snow is injected by means of pressurized air 7 into the tube 1. However, the injection occurs from the first end 10 of the tube 1, wherein the feed line 11 for the dry ice snow 6 is attached by means of a flange 12 to the first end 10 of the tube 1. Therefore, this embodiment does not require any parts that are moved along the tube during the cleaning process.

In this embodiment, the temperature of the tube 1 is measured by means of a temperature sensor 8 at the second end 13 of the tube. When the cleaning process is started, the tube first undergoes cooling at the first end 10 where the dry snow 6 enters first into the free cross section 5 of the tube 1. This cooling of the tube 1 then spreads, as the cleaning is continued, in the longitudinal direction of the tube 1, until the second end 13 of the tube is also cooled. This cooling at the second end 13 of the tube 1 is detected by means of the temperature sensor 8.

In the represented embodiment, it is assumed that, when the temperature sensor 8 at the second end 13 of the tube 1 reaches a cooling of 3° C., in comparison to the initial temperature of the tube 1 before the introduction of the dry snow 6, the tube 1 has been cleaned over its entire length.

For the purpose of the original disclosure, reference is made to the fact that all the features, as they are disclosed to a person skilled in the art from the present description, the drawings and the claims, even if they have been described in concrete terms only in connection with certain additional features, can be combined both individually and also in any desired combinations with other features or groups of features disclosed here, to the extent that this is not explicitly excluded, or to the extent that technical circumstances make such combinations impossible or unreasonable. A comprehensive, explicit description of all the conceivable combinations of features is omitted here only for the sake of the brevity and readability of the description.

While the invention has been represented and described in detail in the drawings and in the above description, this representation and this description occur only by way of example and are not intended to limit the scope of protection as defined by the claims. The invention is not limited to the embodiments that have been disclosed.

Variant forms of the disclosed embodiments are evident to the person skilled in the art from the drawings, the description and the appended claims. In the claims, the word "comprise" does not exclude other elements or steps, and the indefinite article "an" or "a" does not exclude a plural. The mere fact that certain features are claimed in different claims does not rule out their combination. Reference numerals in the claims are not intended to limit the scope of protection.

REFERENCE NUMERALS

1 Tube
2 Inner tube wall
3 Cleaning lance
4 Outlet nozzle
5 Free tube cross section
6 Dry ice snow
7 Pressurized air
8 Temperature sensor
9 Direction of movement
10 First end of the tube
11 Feed line
12 Flange
13 Second end of the tube
101 Roll stand
102, 103 Roll
104 Rolling mandrel
105 Feeding clamping carriage
106 Linear motor
111 Hollow shell
112 Chuck
116 Rotor
117 Stator

The invention claimed is:

1. A method for producing a steel tube comprising the steps of:

manufacturing said steel tube having an inner tube wall, an outer tube wall, and a free tube cross-section enclosed by the inner tube wall, wherein after the manufacturing, the steel tube includes at least one contaminant on the inner tube wall;

cleaning the inner tube wall by introducing liquid or solid $CO_2$ into the free tube crosssection and applying the liquid or solid $CO_2$ onto the inner tube wall to remove the at least one contaminant from the inner tube wall, wherein the liquid or solid $CO_2$ is introduced from a first end of the steel tube into the free tube cross section, measuring the temperature of the steel tube during the application of the liquid or solid $CO_2$ onto the inner tube wall, and interrupting cleaning if the temperature of the steel tube falls below a predetermined temperature threshold.

2. A method according to claim 1, wherein the manufacturing of the steel tube includes forming a hollow shell in a form of a finished dimensioned steel tube.

3. A method according to claim 2, wherein the forming is performed by cold pilgering the hollow shell to the form of the finished steel tube.

4. A method according to claim 3, wherein, during the cold pilgering, a mandrel bar lubricant is transferred from a mandrel bar to the inner tube wall and removed again from the inner tube wall by applying the liquid or solid $CO_2$.

5. A method according to claim 2, wherein the forming is performed by cold drawing the hollow shell into the form of the finished steel tube.

6. A method according to claim 5, wherein during the cold drawing, a drawing oil is transferred from a drawing core to the inner tube wall and removed again from the inner wall by applying the liquid or solid $CO_2$.

7. A method according to claim 1, wherein measuring the temperature during the application of the liquid or solid $CO_2$ onto the inner tube wall includes measuring the temperature at a second end of the steel tube.

8. A method according to claim 7, wherein the predetermined temperature correlates to a state of cleanliness of a surface of the steel tube.

9. A method according to claim 1, wherein the cleaning of the inner tube wall occurs by $CO_2$ snow blasting or by dry ice blasting.

10. A method according to claim 1, wherein introducing the liquid or solid $CO_2$ includes feeding pressurized air into the free tube cross-section.

11. A method according to claim 1, wherein introducing liquid or solid $CO_2$ into the free tube cross-section includes inserting a lance into the free tube cross-section, wherein measuring the temperature of the steel tube includes measuring a temperature of the outer tube wall with a temperature sensor, and wherein the method further comprises simultaneously moving the cleaning lance and the temperature sensor in a longitudinal direction along the tube.

12. A method according to claim 11, wherein the method further comprises maintaining the temperature sensor and an outlet nozzle of the cleaning lance at the same longitudinal position while moving in the longitudinal direction along the tube.

13. A method according to claim 11, wherein the predetermined temperature correlates to a state of cleanliness of a surface of the steel tube.

14. A method according to claim 1, wherein the predetermined temperature correlates to a state of cleanliness of a surface of the steel tube.

* * * * *